US005182190A

United States Patent [19]

Le Faou et al.

[11] Patent Number: 5,182,190

[45] Date of Patent: Jan. 26, 1993

[54] METHOD FOR OBTAINING A PHOTOGRAPHIC COATING COMOPSITION

[75] Inventors: Jacques Le Faou, Chalon sur Saone; Jean-Claude Hervieux, Chatenoy le Royal, both of France

[73] Assignee: Eastman Kodak Company, Rochester, N.Y.

[21] Appl. No.: 548,877

[22] PCT Filed: Jan. 6, 1989

[86] PCT No.: PCT/EP89/00016

§ 371 Date: Sep. 14, 1990

§ 102(e) Date: Sep. 14, 1990

[87] PCT Pub. No.: WO89/06829

PCT Pub. Date: Jul. 27, 1989

[30] Foreign Application Priority Data

Jan. 18, 1988 [FR] France ..... 88 00750

[51] Int. Cl.[5] ..... G03C 1/06; G03C 1/025

[52] U.S. Cl. ..... 430/546; 430/569; 430/631; 430/642; 430/935; 252/314

[58] Field of Search ..... 430/935, 546, 642, 631, 430/569; 252/314

[56] References Cited

U.S. PATENT DOCUMENTS

| | | | |
|---|---|---|---|
| 2,316,845 | 4/1943 | Craft, Jr. | 95/7 |
| 2,413,207 | 12/1946 | Baker | 95/7 |
| 2,851,364 | 9/1958 | Peebles | 99/130 |
| 2,949,360 | 8/1960 | Julian | 430/546 |
| 3,163,543 | 12/1964 | Gorfinkle | 99/134 |
| 3,164,560 | 1/1965 | Suter | 260/6 |
| 3,396,027 | 8/1968 | McFall et al. | 430/546 |
| 3,619,236 | 11/1971 | Dappen et al. | 117/34 |
| 3,655,166 | 4/1972 | Sauer et al. | 259/27 |
| 3,728,280 | 4/1973 | Sauer et al. | 252/314 |
| 3,779,518 | 12/1973 | Koepke et al. | 259/18 |
| 3,810,778 | 5/1974 | Wang | 117/34 |
| 3,847,616 | 11/1974 | Kaneko et al. | 96/94 R |
| 3,900,326 | 8/1975 | Herzhoff et al. | 96/114.8 |
| 4,307,055 | 12/1981 | Takeda et al. | 430/642 |

FOREIGN PATENT DOCUMENTS

| | | | |
|---|---|---|---|
| 158342 | 1/1983 | Fed. Rep. of Germany | 430/935 |
| 3406600 | 8/1984 | Fed. Rep. of Germany . | |
| 278881 | 5/1990 | Fed. Rep. of Germany | 430/935 |
| 1111027 | 2/1956 | France . | |
| 2111176 | 6/1972 | France . | |
| 2193134 | 7/1990 | Japan | 430/569 |
| 1325390 | 8/1973 | United Kingdom . | |
| 1501515 | 2/1978 | United Kingdom . | |

*Primary Examiner*—Marion E. McCamish
*Assistant Examiner*—Janis L. Dote
*Attorney, Agent, or Firm*—Carl F. Ruoff

[57] ABSTRACT

The present invention relates to a method for obtaining a silver halide photographic composition for a coating layer. The method consists in individually preparing the various components of the desired layer, comprising at least one silver halide emulsion, and solutions or dispersions containing one or more finishing addenda and/or gelatin, chilling these components to solidify each of them, cutting them into chunks, cold-blending, in a solid state, the components selected according to the formulation of the desired layer, and liquefying the resulting solid composition just before its introduction into the coating station. The method can be applied to all types of silver halide photographic products, for black and white or color photography.

10 Claims, No Drawings

METHOD FOR OBTAINING A PHOTOGRAPHIC COATING COMOPSITION

The present invention relates to a method for obtaining photographic compositions for a coating layer.

In the following description, the terms "silver halide photographic emulsion" or "emulsion" refer to an emulsion formed of gelatin, containing silver halides, prepared by precipitation, washing, and spectral and chemical sensitizations. Conventionally, at this step, the emulsion is cold-stored, before melting, finishing and coating. The term "finishing addenda" particularly refers, but is not limited to addenda such as anti-fogging agents, stabilizers, coating additives, coupler dispersions, which are usually added to the melted emulsion before coating. The term "coating composition" refers to the composition ready to be coated, containing the finishing addenda.

A conventional method for preparing a coating composition consists in melting in a kettle a silver halide emulsion which is prepared beforehand and cold-stored, adding therein the finishing addenda and feeding the liquid emulsion into the coating machine.

However, it is difficult to obtain, according to this method, homogeneous and reproducible products, without important losses.

Another method of the prior art consists in continuously liquefying the emulsion.

Thus, French patent Agfa 2,111,176 describes a system for continuously melting the emulsion, which consists in crushing the gelled emulsion, under vacuum, then, in liquefying the resulting small granules, still under vacuum, by means of saturated steam at a temperature not exceeding by more than 10° C. the final temperature desired for coating. The liquid emulsion is then fed to a station where it is separated from steam, then it is discharged by a pump toward coating stations. This system prevents overheating near the vessel walls and also provides the continuous production of emulsions with easily reproducible properties.

However, this method exhibits the following drawback: it is not possible to use, just as they are, standard emulsion formulations, since the formulations must be altered by means of water addition. On the other hand, this patent mentions neither the finishing addenda nor the other steps for manufacturing the coating composition. Regarding this point, it can be assumed that the patent implicitly refers to the known or conventional art, wherein the finishing addenda are added to the melting emulsion, which does not totally eliminate the drawbacks of the conventional method in kettle, and particularly, the necessity to check the liquid product just before feeding it to the coating machine.

French patent Agfa 2,277,360 and its English counterpart 1,501,515 describes a method for processing a gelled photographic emulsion, which consists in liquefying gelled emulsion chunks on a heating grid, and then to let the liquid emulsion flow in a mixing-machine comprising various metering pumps allowing to add the finishing addenda in given order and time, the liquid blend thus prepared being then fed into the coating station. The flow of the mixing-machine is equal to the emulsion liquefaction rate.

The waiting time of the melted emulsion with the addenda decreases, but this method exhibits the following drawback: it only allows low flows for the mixing-machine and the coating station, because the heat transfer from the heating grid is not very efficient. Further, such a metering pumps system for adding the addenda is complicated to carry out, and thereby, it is difficult to obtain a reliable system. The pumps must be very accurate, so as to obtain reproducible results, and the quality must be checked on line prior to coating.

German patent Fuji 3,406,600 describes a method in which the gelled photographic emulsion is milled, the resulting chunks are then fed into a heat exchanger, then in a static mixer. The finishing addenda are added in the static mixer, if desired, hence in the remelted emulsion.

In all these methods, the finishing addenda are added to the liquid blend at the melting step, which does not allow to use predetermined formulations, in spite of the improvements which might be otherwise brought, and it is necessary to carry out the checking operations of the liquid composition prior to coating, which may result in stopping the machine, if the checking results are not satisfying. One can never be sure to obtain a good reproducibility and homogeneousness of the sensitometric results on large support surfaces, because the resulting coating continually depends on the quality of the composition which is being prepared.

Further, if the coating composition must contain a complex blend formed of various emulsions, it is then necessary to use a complex system of several liquefactors, so as to feed the coating machine.

Therefore, it was desirable to provide a method for preparing a coating composition that would be simpler, less expensive, and give reliable and reproducible results, on large support surfaces, without inducing interactions with the requirements of the usual formulation required for emulsions and coating compositions.

The present invention proposes a method for preparing a photographic composition for a coating layer, said composition containing at least a silver halide emulsion, as well as the required chemical finishing addenda, the method comprising:

1) preparing individually, or by group, various components of the desired layer, comprising at least one silver halide emulsion and solutions or dispersions containing one or more finishing addenda and/or gelatin, and chilling these components, to solidify each of them,
2) cutting said components into chunks,
3) cold-blending, in a solid state, the components selected according to the formulation of the desired layer, or of a portion of said layer
4) liquefying the resulting solid composition, to feed it into the coating station.

The components individually prepared in step (1) can be individually cold-stored into chunks, either after step (1) or after step (2).

The average volume of chunks does not exceed 2 $cm^3$, so as to insure the homegeneousness of the subsequent blend in the solid state, and preferably, is less than 0.5 $cm^3$.

The coating composition contains at least a silver halide emulsion, but if desired, can contain several of them if desired, for example, two or more emulsions with different sensitivities according to the final formulation of the emulsion layer.

The quality of this solid composition is checked and the amounts of the various components can be adjusted, if necessary. Optionally, the solid composition prepared in step (3) may be cold-stored prior to step (4). Thus, the chilling chain is never broken between the time where the preparations of the silver halide emulsions and the other components are completed, and the step of liquefaction.

The liquefaction step is carried out in a liquefactor which can work by means of a kettle or in a continuous mode, according to the coating station flow.

Thus, the method of the invention allows to obtain a stable coating composition, as it is cold-stored at each step of its preparation, until the liquefaction prior to coating and in which sensitometric and physical characteristics have been previously checked.

Product losses are reduced, as only small quantities are fed at one to the liquefactor. Any composition which has not yet been remelted can be cold-stored again and reused afterwards.

The solid state mixer is a simple, reliable and cheap device. Further, it can be dimensioned so as to prepare significant quantities of composition ready for use, which permits to reduce the variability of a composition characteristics, according to various batches, as the chunks of the composition which are kept at low temperature have therefore a longer time-life, and can be use in larger amounts. Thus, more homogeneous results are obtained, particularly for the speed and the maximum and minimum density. The examples show that the variability of these parameters expressed in standard deviation can be decreased.

Furthermore, the blend formed of various cold emulsions in the solid state mixer, when the formulation requires it, permits to locate only one liquefactor upstream of the coating device.

Thus, a method is provided allowing to obtain, for a lesser cost, absolutely homogeneous large photographic products surfaces, having a controlled quality.

The various components of the desired layer, prepared in step (1) of the method according to the invention, include silver halide emulsions, and pure gelatin solutions or gelatin solutions containing various addends.

Silver halide emulsions are well-known, and they can include all types known. They can be prepared as described in *Research Disclosure* of December 1978, item 17463, paragraph I; they can be washed as described in the paragraph II of the same item, or ultrafiltered as described in the same *Research Disclosure* of October 1972, item 10208 and March 1975, item 13122.

These emulsions can be chemically sensitized, as described in paragraph III of the item 17643 of the above mentioned Research Disclosure of December 1978, and spectrally sensitized, as described paragraph IV, of the same item.

The various chemical finishing addenda can be optical brightening agents, described paragraph V of the same item, antifogging agents, and stabilizers, described paragraph VI, absorbing and scattering materials described paragraph VIII, coating aids described paragraph XI, plasticizers and lubricants described paragraph XII.

The dye-forming couplers as those described, for example, paragraph VII of the item of the above-mentioned *Research Disclosure*, can form one or more components prepared in step (1) of the method of the invention. They are fed into a gelatin solution, as described in paragraph XIV of the above-mentioned item.

The various components prepared in step (1) include at least a silver halide emulsion and at least a gelatin solution containing the chemical addenda. The chemical addenda can all be fed into the same component, or to several of them, according to their nature, their compatibility and their mutual influence on their stability.

A component formed of a gelatin solution without addenda can also be provided for, so as to alter the gelatin content in the final composition, if desired.

The gelatin content of the components prepared in step (1) can be determined by the skilled man, according to the gelatin used and to the other compounds, so as to obtain non-tacky chunks after cutting. Generally, the gelatin content is in the range of 6% to 20%.

The components thus prepared are quickly chilled at a temperature in the range of 8° to 15° C., as it is known in the art, then they can be immediately cut into chunks and cold-stored, or first cold-stored and then cut into chunks, depending on the manufacturing conditions.

The gelled components are divided into chunks having a volume of less than 2 $cm^3$, preferably of less than 0.5 $cm^3$, having a suitable form, for example, a cubic or cylindrical form such as noodles having a diameter in the range of 0.2 to 1 cm and from 0.2 to 2 cm long. These chunks are obtained by means of conventional cutting devices such as those used for preparing the silver gelatino-halide emulsions, so as to obtain washing noodles, for example, a scraped surface grid, a device such as a mincer, etc.

The chunks are cold-stored, according to the types of the components. They can also be used immediately in the solid state mixer.

To carry out step (3) of the method according to the invention, components formed into cold-stored "chunks" are selected according to the desired final formulation of the layer to be coated. This formulation comprises at least one silver halide emulsion. It can comprise several emulsions with different speeds. It also comprises components formed of gelatin containing the finishing addenda required, and optionally dye-forming couplers. The percentages of the various components are known in the art and the skilled man will be able to choose the desired components in the proper proportions.

The components into chunks thus selected are fed to a solid state blender, cold-held by means of any known system, possibly in a chilling room, at such a temperature that the gelled chunks of the various components cannot be liquefied.

Various types of solid state blenders are known such as rotating cylinders, "tumblers", blenders such as concrete mixer, conical blenders having an Archimedian screw, etc..

The volumes of these blenders can be selected depending on the amounts of the composition coating to be prepared. As an example, and without being limited by a precise range, the volume of commercial devices is in the range from 200 to 12000 liters or more.

The duration of the blending depends on the blender and of the total volume of the components to be blended, and can be determined by the skilled man, according to the desired homogeneousness level. Generally, blending times in the range of 2 mn to 60 mn allow to obtain satisfying photographic products.

Thus, a sampling can be taken from the resulting homogeneous coating composition, so as to check its photographic quality, and it is possible to adjust the composition, if required, without breaking the chilling chain.

Finally, the composition is liquefied to be fed into a coating station. In a preferred embodiment, a continuous liquefaction system is used, which works according to the requirements of the coating station. Such a system is known in the art. It can simply comprise an Archimedian screw and a pump feeding the solid composition into a heat exchanger.

The use of such a solid composition allows to use only one liquefactor, even if the composition contains several components, e.g. emulsions of various speeds. The use of only one liquefactor represents a significant economy in terms of equipment. However, several liquefactors can be used when the solid composition represents only a portion of the desired layer.

The method according to the invention can be applied to all types of known silver halide photographic products, such as products for black and white or color photography, X-ray products, graphic arts products, etc.

The examples further illustrate the invention:

EXAMPLE 1

The following mixtures were prepared:

a slow-speed bromoiodide emulsion, a medium-speed bromoiodide emulsion, a fast-speed bromoiodide emulsion, a dispersion of a magenta coupler solubilized in the appropriate solvent in gelatin, an aqueous solution comprising gelatin, an antifoggant, and coating aids.

These mixtures with a gelatin basis were chilled and cut into chunks at 12° C., then cold-stored at 7° C.

To prepare the coating composition, chunks of each mixture were taken in the ratios desired for the final composition.

All the selected chunks were introduced in the solid state mixer and homogeneized for 30 mn. The resulting composition was fed to the liquefaction device and the coating station according to the invention.

Variabilities of D max, D min, and the relative speed were measured.

The results are the following:

TABLE I

| Variability | D min | Relative speed | D max |
|---|---|---|---|
| Average | 0.08 | 79 | 2.40 |
| Mini | 0.08 | 77 | 2.32 |
| Maxi | 0.09 | 81 | 2.42 |
| Standard deviation 2σ | 0 | 1.6 | 0.026 |

EXAMPLE 2

A color positive film was prepared from compositions of magenta, cyan, and yellow layers, all prepared according to the method of the invention.

In table II the speeds obtained with products prepared according to the invention are compared to the speeds obtained with standard emulsions, i.e., obtained by melting in a kettle a silver halide emulsion which is prepared beforehand and cold-stored, adding therein the finishing addenda and feeding the liquid emulsion into the coating machine.

TABLE II

| | Blue | | Green | | Red | |
|---|---|---|---|---|---|---|
| Variability | Inv. | St. | Inv. | St. | Inv. | St. |
| Average | 255.3 | 253.6 | 235.1 | 234.5 | 226.8 | 231.3 |
| Range | 1.0 | 2.3 | 1.4 | 2.3 | 1.1 | 2.3 |
| Standard deviation 2σ | 0.612 | 1.114 | 0.876 | 1.039 | 0.482 | 1.114 |

Inv. = Invention
St. = Standard

These results show to which extent the invention permits to achieve an improved speed uniformity in any of the blue, green or red units. In the blue and red units the standard deviation of the speed is practically divided by 2.

We claim:

1. A method for preparing a photographic composition for a coating layer having a desired formulation, said formulation containing at least a silver halide emulsion and chemical addenda, and gelatin, the method comprising in order the following steps:

1)(a) preparing individually a plurality of components of the desired formulation, said components being selected from (i) silver halide emulsions, or (ii) materials selected from the group consisting of solutions or dispersions of chemical addenda and gelatin, and 1)(b) separately solidifying each of said plurality of components by chilling;

2) separately cutting each of said plurality of components into chunks;

3) selecting the amount of chunks from step 2 of each of said plurality of components so as to produce the desired formulation of the coating layer;

4) cold blending, in a solid state, the chunks of said plurality of components selected from step 3;

5) liquefying the resulting blend obtained in step 4 prior to feeding it into a coating station.

2. A method according to claim 1 wherein the chunks in step (2) have a volume less than 2 $cm^3$.

3. A method according to claim 2 wherein the chunks in step (2) have a volume less than 0.5 $cm^3$.

4. A method according to claim 1, wherein each of said plurality of components prepared in step (1) are individually cold stored between step (1) and step (2).

5. A method according to claim 1 wherein each of said plurality of components prepared in step (1) are individually cold stored in chunks between step (2) and (4).

6. A method according to claim 1 wherein the blend of said plurality of components prepared in step (4) is cold stored prior to step (5).

7. A method according to claim 1 wherein the formulation comprises more than one silver halide emulsion.

8. A method according to any of claims 1 to 7, wherein the blend prepared in step (4) represents a portion of the coating layer.

9. A method according to claim 1 wherein the chemical addenda are dye forming couplers, stabilizers, antifogging agents, plasticizers, lubricants, absorbing and scattering materials, coating aids or optical brightening agents.

10. A method according to claim 1, wherein step (5) is continuously carried out in a liquefactor working according to the coating station flow.

* * * * *

UNITED STATES PATENT AND TRADEMARK OFFICE

CERTIFICATE OF CORRECTION

PATENT NO. : 5,182,190

DATED : Janauary 26, 1993

INVENTOR(S) : Jacques Le Faou and Jean-Claude Hervieux

It is certified that error appears in the above-indentified patent and that said Letters Patent is hereby corrected as shown below:

On the title page, item [54] and in column 1, lines 2 and 3, in the title "METHOD FOR OBTAINING A PHOTOGRAPHIC COATING COMOPSITION" should read --METHOD FOR OBTAINING A PHOTOGRAPHIC COATING COMPOSITION--.

Signed and Sealed this

Fifth Day of April, 1994

Bruce Lehman

*Attest:*

BRUCE LEHMAN

*Attesting Officer*

*Commissioner of Patents and Trademarks*